United States Patent [19]

Dekura

[11] Patent Number: 5,034,525

[45] Date of Patent: Jul. 23, 1991

[54] SYNTHETIC LUBRICANT

[76] Inventor: Takateru Dekura, No.1-3, Sasame-cho, Kamakura-shi, Kanagawa-ken, Japan

[21] Appl. No.: 245,728

[22] Filed: Sep. 19, 1988

[51] Int. Cl.[5] ..... C10M 105/70

[52] U.S. Cl. ..... 544/196; 252/54; 252/51.5 A; 252/58; 544/199; 544/206; 544/207

[58] Field of Search ..... 252/515 A, 58, 54; 544/196, 199, 204, 206, 207

[56] References Cited

U.S. PATENT DOCUMENTS

| | | | |
|---|---|---|---|
| 3,654,273 | 4/1972 | Schuman et al. | 544/216 |
| 3,758,555 | 9/1973 | Koshar et al. | 544/216 |
| 3,816,416 | 6/1974 | Croft et al. | 544/216 |
| 4,647,413 | 3/1987 | Savu | 544/216 |

FOREIGN PATENT DOCUMENTS

| | | | |
|---|---|---|---|
| 867279 | 5/1961 | United Kingdom | 260/249.6 |

*Primary Examiner*—Jacqueline V. Howard

*Attorney, Agent, or Firm*—Fleit, Jacobson, Cohn, Price, Holman & Stern

[57] ABSTRACT

The lubricants according to the present invention are comprised of fluorine-containing alkyl carbonyl, polyperfluorooxyalkylenefluoropropionyl, polyperfluorooxyalkylene copolymerized oxyfluoroalkyl carbonyl chains and the like, and of which compounds are reacted with hetero cyclic groups obtained by amidization with polar groups between the radicals and compounds with typical organic end-groups.

The novel compounds referred to above are lubricants characterized in that they can be represented by the general formula (1) and that the molecular weight of Rf ranges from 200 to 15,000.

$$\begin{matrix} Rf{-}Z, & 2\,(Rf){-}Z \\ 3\,(Rf){-}Z & \end{matrix} \qquad (1)$$

wherein Rf represents any one of the following groups:

$X(C_3F_6O)_l CFYCO{-}$ $X(C_3F_6O)_l(CF_2O)_m CFYCO{-}$ $X(C_2F_4O)_l(CF_2O)_m CFYCO{-}$ $X(CF_2)_{l-1} CO{-}$ $X(CF_2)_{l-1} CH_2CO{-}$ $X(CF_2)_{l-1} CH_2CH_2CO{-}$ where l is an integer having a value between 3 and 150, and m an integer ranging from 1 to 50, and where X may be H—, F—, $CF_3$—, $C_2F_5$—, $C_3F_7$—, $CF_3O$—, $C_2F_5O$—, or $C_3F_7O$—, and Y may be F—, $CF_3$—, or $C_2F_5$— respectively.

Z may be classified into any one of the following groups: 1) pyridine ring, 2) pyrimidine ring, 3) piperazine ring, and 4) triazine ring. The most typical representatives of these groups are the amino compounds that may be described as stated below, and the amide compounds obtained by reaction with these.

4 Claims, 2 Drawing Sheets

SYNTHETIC LUBRICANT

BACKGROUND OF THE INVENTION (1) Field of the Invention

The present invention relates to fluorine-containing compound having pyridine, pyrimidine, piperazine, and triazine of hetero cyclic amide as substituents. The lubricants in accordance with this invention may take the form of solid or liquid lubricants and can be used for the lubrication and rust-prevention of the contact surfaces of a machine or equipment with moving parts, in which applications they will produce a superior effect.

(2) Description of the Prior Art

Fluorine-containing lubricants as part of the synthetic lubricants are known to include fluorosilicone oil, perfluorochloroethylene oil, and perfluoroalkyl polyether.

While these compounds are used for their heat resistance and chemical inertness as the main properties favoring their application for this purpose, they present many deficiencies in their lubricating behavior due to their inherent adsorptivity.

In an attempt to overcome this shortcoming, U.S. Pat. No. 3,723,317 purports to improve these properties by the addition of 1,3,5-triazine to the fluorine-containing lubricant base oil. Recently, however, it is described in the Japanese Patent Provisional Publication No. 155345/86 of the Italian company Montedison S.p.A., and at ASLE in the United States of America (April 30–May 3, 1979), Mr. William R. Jones Jr. and Mr. Carl E. Snyder Jr. have presented a statement concerning the lubricating properties of perfluorotriazine synthetic lubricants obtained by directly attaching a perfluoropolyether group to the carbon atom.

The application fields in which these lubricants have been used in recent years include, for example, such electronic equipment areas as electromagnetic disk surface, connector and electric contactor lubrication, and many of these applications make use of inorganic and organic materials. It has been realized, however, that the service life of the equipment is difficult to extend simply and solely on account of the lubricant's wetting behavior.

Moreover, in bearings with oil and grease lubrication, it has been found that fluorine-containing lubricants have inadequate adhesion to metals so that, in the case of general bearing steels, their use will lead to poorer corrosion protection and a reduced bearing service life, a problem that needs to be resolved.

Fluorine-containing lubricants are attracting much attention and are being extensively used, chiefly in those areas in which chemical inertness and heat resistance are an important requirement.

These lubricants have been the object of much research aimed at further development to obtain stabler compounds capable of resisting more severe application conditions.

For this reason, the main application fields for these lubricants have been limited to such areas as the semiconductor industry using non-flammable, corrosive gases and low vapor pressure, the mechanical sector for bearings and machine conveyors and chains operated at high temperatures, and peripheral furnace equipment.

As the superior properties of fluorine-containing lubricants were recognized, however, their application range widened to include factory automation equipment, industrial robots, computer-related equipment, and electrical household appliances.

To permit its use for such equipment, a lubricant is required to meet a variety of specifications, and the fact is that the fluorine-containing lubricants available so far have, in most cases, not been able to fulfill these requirements.

The perfluoroalkylpolyether lubricants, that is, substances in which all hydrogen atoms of the alkyl group have been substituted by fluorine atoms, present difficulties in terms of their poor load resistance properties, if they have a low molecular weight.

By contrast, perfluoroalkylpolyethers having a high molecular weight have a low surface tension and favorable wetting properties but lack adhesion to metal surfaces to that, when used in machine parts rotating at a high speed, the lubricant will migrate and thus provide inadequate lubrication.

Further defects of these lubricants are due to their poor compatibility with other types of lubricants (mineral oil type lubricants) and their tendency to disperse under the action of applied centrifugal forces.

If, however, these lubricants are over-stabilized, the result will be that while their adsorption on metals remains poor, their lubricating effect as a lubricant for slide-way movement will be very satisfactory in the initial period but this effect tends to diminish as the amount of lubricant appropriate for the lubrication of the equipment will decrease as time passes.

For this reason, some applications have necessitated a certain trade-off by sacrificing of the stability of the lubricant to a given extent for the sake of enhancing its adsorptivity.

SUMMARY OF THE INVENTION

The aim of the present invention, as the result of the most dedicated research on the problems referred to above, is to provide synthetic lubricants with an enhanced adsorption on metals and other inorganic and/or organic materials, improved anti-corrosion and load resistance properties, a favorable lubricating behavior, and low flammability.

DESCRIPTION OF THE PREFERRED EMBODIMENTS

Figure 1:
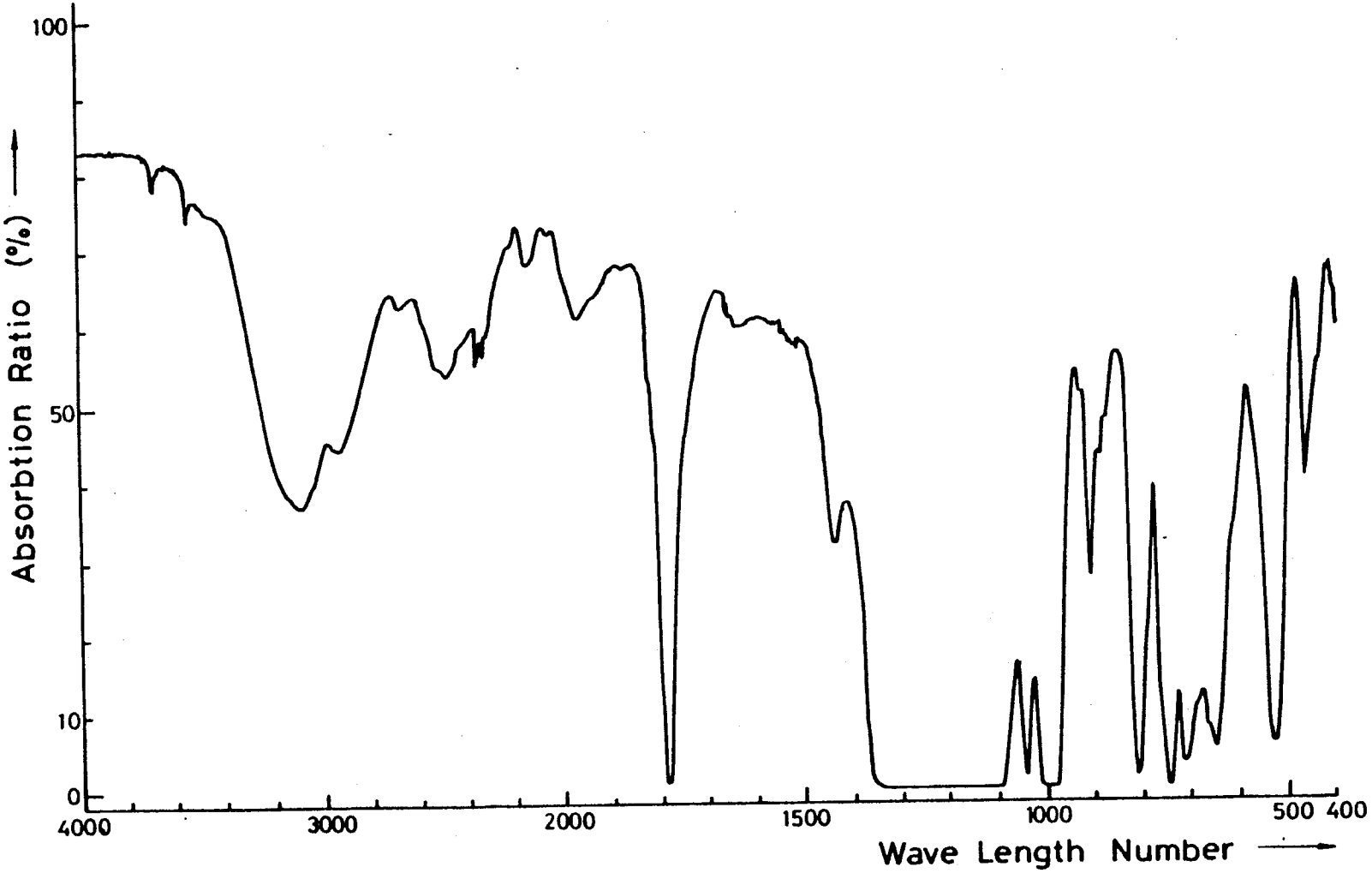
FIG. 1 represents the perfluoropolyoxypropyleneperfluoropropionic acid constituting the starting material in accordance with the present invention and FIG. 2 is the infrared absorption spectrogram for the substance of Example 3 corresponding to formula (3).

The present invention will be explained in detail hereinunder.

In terms of their general structures, the lubricants according to the present invention are comprised of fluorine-containing alkyl carbonyl, polyperfluorooxyalkylenefluoropropionyl, polyperfluorooxyalkylene-copolymerized-oxyfluoroalkylcarbonyl chains and the like, and of which compounds are reacted with heterocyclic groups and obtained by amidization with polar groups between the radicals and compounds with typical organic end-groups.

The novel compounds referred to above are lubricants characterized in that they can be represented by the general formula (1) and that the molecular weight of Rf ranges from 200 to 15,000.

$$\begin{matrix} Rf—Z\ (Rf)—Z \\ 3\ (Rf)—Z \end{matrix} \quad (1)$$

wherein Rf represents any one of the following groups:

$X(C_3F_6O)_l CFYCO—$ $X(C_3F_6O)_l(CF_2O)_m CFYCO—$ $X(C_2F_4O)_l(CF_2O)_m CFYCO—$ $X(CF_2)_{l-1} CO—$ $X(CF_2)_{l-1} CH_2CO—$ $X(CF_2)_{l-1} CH_2CH_2CO—$ where l is an integer having a value between 3 and 150, and m an integer ranging from 1 to 50, and where X may be H—, F—, $CF_3$—, $C_2F_5$—, $C_3F_7$—, $CF_3O$—, $C_2F_5O$—, or $C_3F_7O$—, and Y may be F—, $CF_3$—, or $C_2F_5$, respectively.

Z may be classified into any one of the following groups: 1) pyridine ring, 2) pyrimidine ring, 3) piperazine ring, and 4) triazine ring. The most typical representatives of these groups are the amino compounds that may be described as stated below, and the amide compounds obtained by reaction with these.

(1) Pyridine Derivatives

Amino pyridine (amino group in 2,3,4 position)

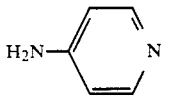

(4-amino pyridine)

Di-amino pyridine (amino groups in 2,3-, 2,5-, 2,6-, and 3,5 positions)

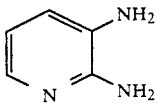

(2,3-di-amino pyridine)

Amino-alkyl pyridine (4-methyl, 5-methyl, 6-methyl, 4-ethyl, 4-propyl)

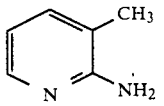

(2-amino-3-methyl pyridine)

Triamino pyridine

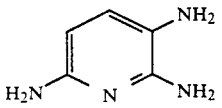

(2,3,6-tri-amino-pyridine)

(2) Pyrimidine Derivatives

Amino pyrimidine

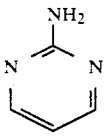

(2-amino pyridine)

Amino-alkyl, di-alkyl, alkyl-alkoxy, di-hydroxy, pyrimidine

-continued

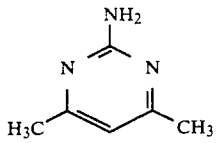

(2-amino-4,6-di-methyl pyrimidine)

Triamino pyrimidine

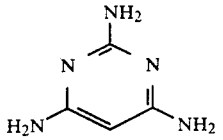

(2,4,6-triamino pyrimidine)

(3) Piperazine Derivatives

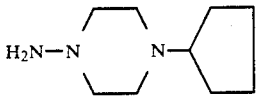

(1-amino-4-cyclopentyl piperazine)

(4) Triazine Derivatives

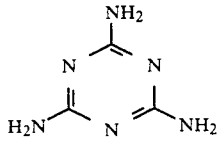

(2,4,6-tri-amino-1,3,5-triazine)

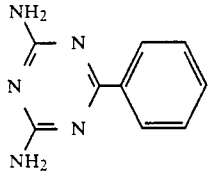

(2,4-di-amino-6-phenyl-1,3,5-triazine)

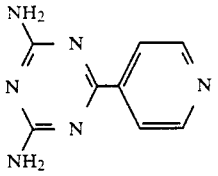

(2,4-di-amino-6-(4-pyridyl)-S-triazine)

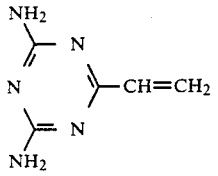

(2,4-di-amino-6-(vinyl)-S-triazine)

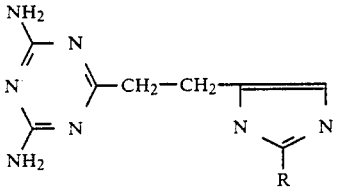

R: Methyl, ethyl, undecyl
(2,4-di-amino-6-[2'-alkyl-imidazyl-(1)]-ethyl-S-triazine)

The group Rf added to the above formula (1) may be one or two, or three groups which may be identical or different. The group Rf need not have all of its hydrogen atoms substituted by fluorine atoms, as adequate lubricating properties will be assured even if a certain percentage of hydrogen is present.

If Rf consists of a perfluoroalkyl, fluoroalkyl or methyl/ethyl carbonyl group, the compounds will have a pasty or solid consistency in the normal temperature range.

If a liquid compound is to be obtained, a fluorooxyethylene, fluorooxymethylene, or fluorooxypropylene group should be introduced, with the viscosity of the resulting compound being controlled by the molecular weight.

Consequently, the fluorine-containing heterocyclic amide compounds consisting of various derivates of pyridine, pyrimidine, piperazine, and triazine compounds can be used as most effective lubricants for various types of machines or equipment by making use of their particular features in terms of their high melting point, high viscosity, and low pour point to suit the application purpose. These compounds have a density ranging from 1.5 to 1.9 and possess a favorable adsorption with respect to inorganic and organic materials even when used in sliding parts and parts rotating at high speed. They provide a rust inhibition effect on metals and are further distinguished by a high wetting power due to their low surface tension, poor flammability, and excellent lubricating behavior.

EXAMPLES

Examples will be shown in the following.

The following are some practical examples of the present invention which shall, however, not be limited by, or restricted to, these examples.

EXAMPLE 1

9.0 g (0.094 mol) of aminopyrimidine were dissolved in 100 ml of refined, dehydrated N,N'-dimethylformamide in a stirred 500 ml four-way flask equipped with a reflux cooler and a thermometer, and the solution was treated with 9.1 g (0.094) of triethyl amine by stirring the mixture until it was homogeneous.

The resulting solution was kept at a temperature of 5° C. and 200 g (0.09 mol) of perfluoroalkyl polyether perfluoropropionyl chloride [average molecular weight 2,200 (determined by nuclear magnetic resonance spectroscopy), formula: $F(C_3F_6O)_{\bar{l}}C_2F_4COCl$, l approximately 12, acid number 25 mg KOH/g viscosity at 38° C. 120 centi-stokes], dissolved in 200 ml of trichlorotrifluoroethane refined in a separating funnel, were dripped into the above solution for one hour. After dripping, the mixture was stirred for a further 24 hours at 5° C. on a reflux cooler to bring the reaction to completion.

After the reaction was complete, the remaining trichlorotrifluoroethane was distilled off at 60° C. and a small amount of 0.25N hydrochloric acid and 200 ml of methyl alcohol was added.

The resulting solution was then passed into a separating funnel for separation to withdraw the supernatant. The bottom layer was again treated with 100 ml of methyl alcohol for purification at least three times with subsequent removal of the solvent by vacuum distillation.

The residue was purified at least two or three times with distilled water until no color change was detectable in the presence of methyl orange indicator. 150 ml of trichlorotrifluoroethane were then added to the bottom layer and after filtration through a 5C filter paper to remove impurities, the solvent was distilled off. The unreacted perfluoroalkylpolyetherperfluropropionic acid was distilled off in the temperature range 152°-158° C. at a vacuum drawn to 0.03 mm Hg, when the product was obtained as a light-brown liquid compound in 80% yield.

Determination of the acid number of this liquid compounds by potentiometric titration (AT-200 manufactured by Kyto Denshi Kogyo Kabushiki Kaisha) gave a value of 0.5 mg KOH/g, and the viscosity at 40° C. was 155 centi-stoke.

Infrared spectral analysis (performed with an IR spectrometer model IR810 manufactured by Nihon Bunko Kogyo Kabushiki Kaisha) showed that the 1780 $cm^{-1}$ absorption band characteristic of the carboxylic acid had been lost and that an absorption band in the 1210-1330 $cm^{-1}$ range typical of the CF bond, amide absorption bands at 1680-1700 $cm^{-1}$ and 3350 $cm^{-1}$ and carbon-hydrogen oscillation absorption bands at 2850 and 2950 $cm^{-1}$ were present instead.

Elemental analysis performed with a YANACO CHN coder MT3 model manufactured by Kabushiki Kaisha Yanagimoto Seisakusho revealed 23.0% C and 1.9% N as compared with theoretical values of 23.10C and 1.88% N. In view of the virtually complete agreement between the analysis results and the theoretical values, it was established that the product formed in the above reaction procedure had the formula (1):

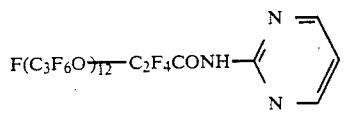

(1)

EXAMPLE 2

11 g (0.101 mol) of 3-diamino pyridine were dissolved in 100 ml of refined, dehydrated N,N'-dimethylformamide in a stirred 500 ml four-way flask equipped with a reflux cooler and a thermometer, and the solution was treated with 21 g (0.207) of triethylamine by stirring the mixture for 15 minutes at a temperature of 5° C.

While the resulting solution was being stirred, 100 g (0.201 mol) of perfluoroalkylmethylcarbonyl chloride [molecular weight 496.5, formula: $C_8F_{17}CH_2COCl$, (melting point: 29° C., boiling point: 81°-82° C. as 11 mm Hg)] dissolved in 150 ml of perfluorodimethyl cyclohexane (commercial name: FLUTEC PP3), refined by means of a separating funnel, were dripped into the above solution for one hour. After dripping, the mixture was stirred for a further 24 hours at 5° C. to bring the reaction to completion.

After the reaction was complete, the solution was transferred into a separating funnel and to remove the unreacted amine, a small amount of 0.25 N hydrochloric acid was added and the aqueous supernatant was repeatedly washed out with distilled water at least three or four times until no color change was detectable in the presence of methyl orange indicator.

The bottom layer was subjected to a gradually drawn vacuum to remove the minor amounts of water and solvents contained therein by distillation. After elimination of the unreacted perfluorooctylmethylcarboxylic acid by renewed distillation at a temperature of 115° C.-120° C. in a vacuum of 5 mm Hg, the product was obtained as a light-brown solid substance in 85% yield. The melting point of this substance was determined and found to be 93°-95° C.

The acid number of this substance was determined in the same manner as described for Example 1, when a value of 0.2 mg KOH/g was found. Infrared spectral analysis showed that the 1780 $cm^{-1}$ absorption band had been lost and that an absorption band in the 1210–1330 $cm^{1}$ range typical of the CF bond as well as strongly pronounced amide absorption bands at 1670–1700 $cm^{1}$ and 3350 $cm^{1}$ were present.

Elemental analysis revealed contents of 28.8% C and 4.0% N as compared with theoretical values of 29.15% C and 4.08% N. In view of the virtually complete agreement between the analysis results and the theoretical values, it was established that the product concerned had the formula (2).

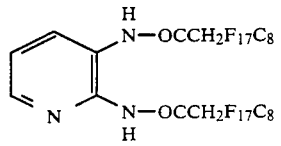

(2)

EXAMPLE 3

10.5 g (0.056 mol) of 2,4-diamino-6-phenyl-1,3,5-triazine were dissolved in 100 ml of refined, dehydrated N,N'-dimethylformamide in a 500 ml four-way flask in the same manner as described in Example 1 and the solution was treated with 11 g (0.109) of triethyl amine by stirring the mixture at a temperature of 5° C. until it was homogeneous.

While the resulting solution was being stirred, 200 g (0.108 mol) of perfluoroalkylpolyetherpropionyl chloride [average molecular weight 1850 (determined by nuclear magnetic resonance spectroscopy), formula: $F(C_3F_6—O)_l—C_2F_4COCl$, where l has an average value of 10, acid number: 32 mg/KOH/g, viscosity at 38° C. 90 centistokes] dissolved in 200 ml of trichlorotrifluoroethane refined by means of a separating funnel, were drippeu into the above solution for one hour. After dripping, the mixture was stirred for a further 24 hours at a temperature of 5° C. to bring the reaction to completion.

After the reaction was complete, the remaining trichlorotrifluoroethane was distilled off at 60° C. and a small amount of dilute hydrochloric acid and 50 ml of methyl alcohol were added.

The solution was transferred into a separating funnel and the supernatant and bottom layer were separated by washing the supernatant with 100 ml of N,N'-dimethylformamide for at least three times and after the unreacted amine had been removed, 200 ml of methanol were added to extract the N,N'-dimethylformamide and the solvent was removed by vacuum distillation. After the residue had been washed out with distilled water at least three times until no color change was detectable in the presence of methyl orange indicator, 200 ml of trichlorotrifluoroethane were added and after filtration had been carried out through a 5C filter paper to remove impurities, the unreacted perfluoroalkylpolyether perfluoropropionic acid (FIG. 1) was distilled off at a temperature of 134°–137° C. in a 0.03 mm Hg vacuum, when the product was obtained as a light-brown liquid compound in 83% yield.

Figure 2:
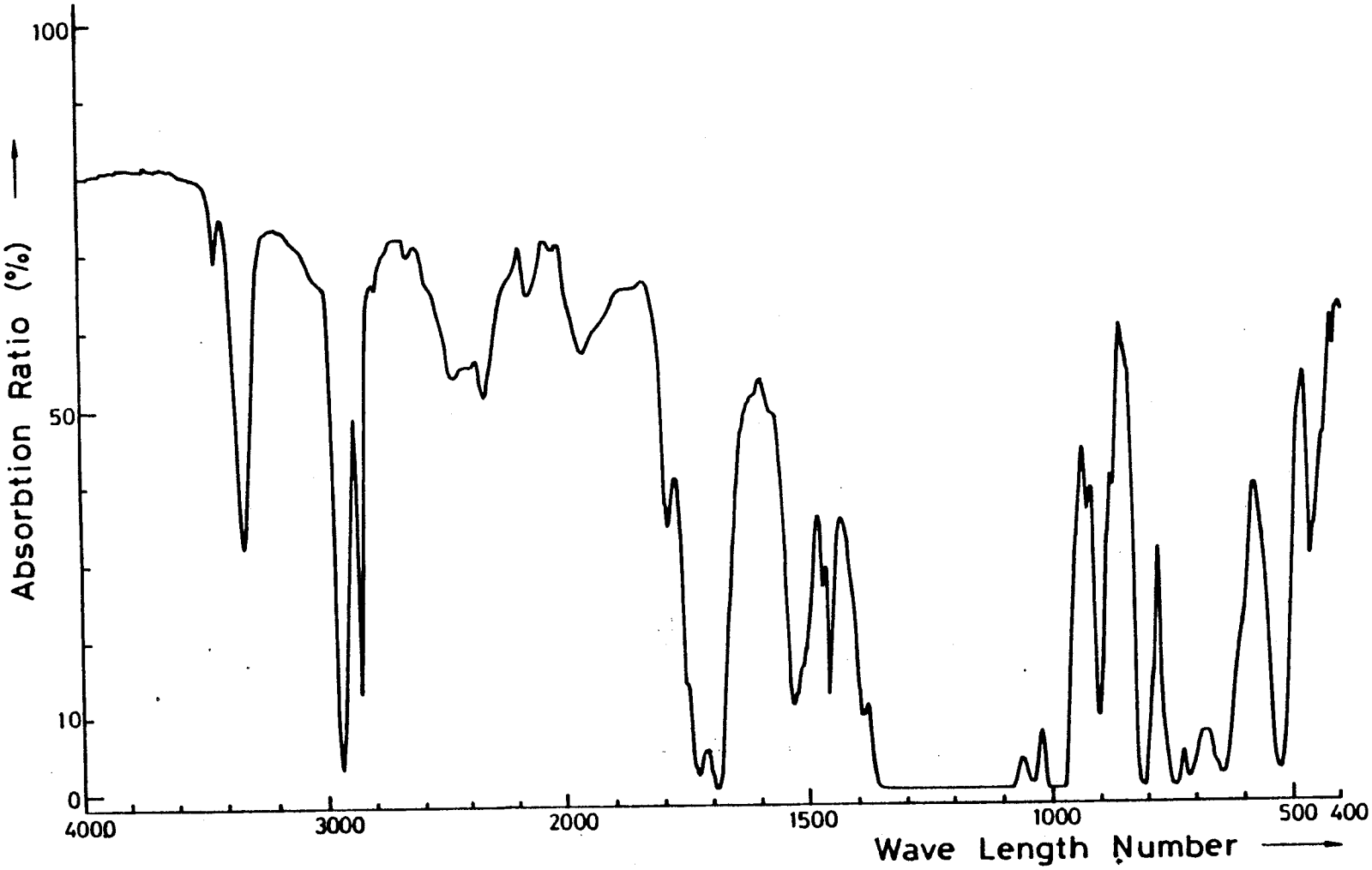

The acid number of this compound (FIG. 2) was determined, when a value of 0.3 mg KOH/g was found. The viscosity at 40° C. was determined as being 210 centi-stokes.

Infrared spectral analysis performed in the same manner as described in Example 1 showed that the 1780 $cm^{-1}$ absorption band had been lost and that amide absorption bands at 1670–1700 $cm^{1}$ and 3350 $cm^{1}$ were present.

Elemental analysis revealed contents of 23.0% C and 1.9% N as compared with theoretical values of 23.69% C and 1.84% N. In view of the virtually complete agreement between the analysis results and the theoretical values, it was established that the product concerned had the formula (3).

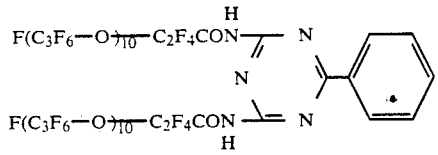

(3)

EXAMPLE 4

9 g (0.071 mol) of 2,4,6-triamino-1,3,5-triazine (specific gravity at 14° C.: 1.57) and 21 g (0.207 mol) of triethylamine were added to 150 ml of refined trichlorotrifluoroethane (specific gravity at 20° C.: 1.57) in a 500 ml four-way flask as described in Example 2 by stirring the mixture until it was homogeneous.

While the resulting solution was kept at a temperature of 5° C., 200 g (0.2 mol) of perfluoroalkylpolyether perfluoropropionyl chloride [average molecular weight 1,000, formula: $F(C_3F_6O)_l—C_2F_4COCl$, (determined by nuclear magnetic resonance spectroscopy), where l has an average value of 5, acid number 65 mg KOH/g, viscosity at 38° C.: 44 centi-stokes] dissolved in a mixture of 100 ml of trichlorotrifluoroethane and 100 ml of refined perfluorodimethylcyclohexane [(boiling point: 102° C., specific gravity at 25° C.: 1.82) commercial name: FLUTEC PP3) refined by means of a separating funnel, were dripped into the above solution for one hour. After dripping, the mixture was stirred on a reflux cooler for a further 48 hours at 5° C. to bring the reaction to completion.

After the reaction is complete, the solution was transferred into a separating funnel and left standing after the addition of 50 ml of methyl alcohol and 50 ml of 0.25 N dilute hydrochloric acid, whereupon the bottom layer was isolated and the unreacted 2,4,6-triamino1,3,5-triazine was separated out by filtration and the solvent removed by distillation at 60° C. The residue was washed with distilled water for at least three or four times until no color change was detectable in the presence of methyl orange indicator.

After washing, the bottom layer part was subjected to vacuum distillation to remove the remaining perfluorodimethylcyclohexane and the unreacted perfluoroalkylpolyetherperfluoropropionic acid was distilled off at a temperature of 85°–100° C. in a vacuum of 0.03 mm Hg, when the product was obtained as a light-brown liquid compound in 75% yield.

The acid number of this compound was determined in the same manner as described in Example 1, when a value of 0.2 mg KOH/g was found. The viscosity at 40° C. was determined as being 135 centi-stokes.

Infrared spectral analysis showed that the 1780 $cm^{-1}$ absorption band had been lost and that well-pronounced amide absorption bands at 1670–1700 $cm^{-1}$ and 3350 $cm^{-1}$ were present.

Elemental analysis revealed contents of 22.0% C and 2.7% N as compared with theoretical values of 22.39% C and 2.75% N. In view of the virtually complete agreement between the analysis results and the theoretical values, it was identified as being

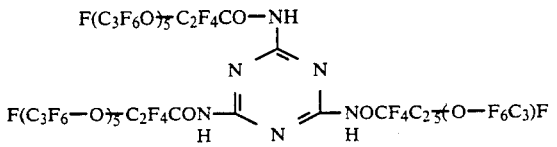

(4)

Table 1 gives the characteristics of the synthetic lubricant compounds obtained in the above examples.

TABLE 1

| | Example 1 | Example 2 (Note 2) | Example 3 | Example 4 | Perfluoro polyether C (Note 1) |
|---|---|---|---|---|---|
| Appearance (Room Temperature) | Clear Umber Liquid | Brown Solid | Clear Yellowish Liquid nonflammable | Clear Amber Liquid | Clear Colorless Liquid |
| Flash Point ASTM D 92 | | | | | |
| Viscosity 40° C. | 155 | Melting point 93–95° C. | 210 | 135 | 240 |
| Viscosity 100° C. ASTM D 445 | 14.0 | | 15.0 | 11.5 | 26.0 |
| Viscosity Index ASTM D 2270 | 85 | | 58 | 61 | 122 |
| Strong Acid No. ASTM D 974 | 0.5 | 0.2 | 0.3 | 0.2 | 0.0 |
| Wear Preventive Characteristic (Four-Ball method) | | | | | |
| Mean Hertz Load, kg | 85 | | 95 | 90 | 98 |
| Incipient Seizure, kg | 220 | | 220 | 250 | 200 |
| Weld Point, kg ASTM D 2783 | 300 | | 320 | 350 | 398 |
| Test for Rust Protection in the Humidity Cabinet ASTM D 1748 | 300 hrs No Rust | 300 hrs No Rust | 300 hrs No Rust | 300 hrs No Rust | 30 min Rust |

Note (1)
Perfluoro polyether C is manufactured by Dupont U.S.A. under the trade name Krytox 143AC (average molecular weight: 6,250) Chemical structure:

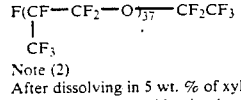

Note (2)
After dissolving in 5 wt. % of xylene and immersing the specimen for 30 minutes, the specimen was withdrawn, the solvent removed by blowing hot air over it and tests were performed.

The fluorine-containing compounds according to the present invention in which pyrizine, pyrimidine, piperazine, and triazine rings are bonded to amides, have properties not found in the conventional lubricants and their use provides superior characteristics in terms of the adsorption behavior on metal surfaces, corrosion prevention, and lubricating properties under high loads.

In addition, the low flammability of these lubricants under handling conditions ensures safety in use.

If these compounds are used either on their own or in combination with perfluoropolyether oil or added to a perfluoropolyether type greases, they will therefore provide a very favorable lubricating action over a long time when used for the lubrication of the contact surfaces of rotating equipment of any kind and equipment with moving parts, being suitable for lubricating all kinds of equipment and magnetic recording devices, connectors and the like.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A synthetic lubricant having the formula (1):

$$(Rf)_n—Z \quad (1)$$

wherein n is an integer from 1 to 3;

wherein

Z is a radical of a triazine compound, said triazine compound having at least one amino group substituent on the triazine ring thereof;

wherein

Rf is a fluorine-containing group having a molecular weight between 200 and 15,000 selected from the group consisting of $X(C_3F_6O)_l—CFYCO—$,
$X(C_3F_6O)_l—(CF_2O)_m—CFYCO—$, and
$X(C_2F_4O)_l—(CF_2O)_m—CFYCO—$, wherein l is an integer between 3 and 150;

m is an integer from 1 to 50;

X is a member selected from the group consisting of H—, F—, $CF_3$—, $C_2F_5$—, $C_3F_7$—, $CF_3O$—, $C_2F_5O$— and $C_3F_7O$—; and Y is a member selected from the group consisting of F—, $CF_3$—, and $C_2F_5$—;

wherein when n is greater than 1, the Rf groups are the same or different; and wherein each Rf-Z bond is a RfNH-triazine ring bond.

2. A lubricant of the formula:

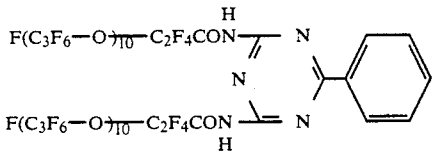

3. A lubricant of the formula:

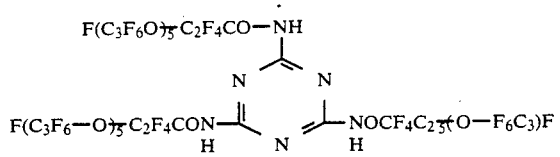

4. A synthetic lubricant according to claim 2, wherein Z is a radical of a compound selected from the group consisting of 2,4,6-triamino-1,3-5-triazine; 2,4-diamino-6-phenyl-1,3,5-triazine; 2,4-diamino-6-(4-pyridyl)-S-triazine; 2,4-diamino-6-(vinyl)-S-triazine; 2,4-diamino-6-[2'-methyl-imidazyl-(1)]-ethyl-S-triazine; 2,4-diamino-6-[2'-ethyl-imidazyl-(1)]-ethyl-s-triazine and 2,4-diamino-6-[2'-undecyl-imidazyl-(1)-ethyl-s-triazine.

* * * * *